US009812809B2

(12) United States Patent
Arai et al.

(10) Patent No.: US 9,812,809 B2
(45) Date of Patent: Nov. 7, 2017

(54) WATERPROOF CONNECTOR

(71) Applicant: Japan Aviation Electronics Industry, Limited, Tokyo (JP)

(72) Inventors: Katsumi Arai, Tokyo (JP); Hiroshi Akimoto, Tokyo (JP); Fumiki Yamada, Tokyo (JP); Toshiyuki Shimoda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/479,025

(22) Filed: Apr. 4, 2017

(65) Prior Publication Data

US 2017/0207569 A1 Jul. 20, 2017

Related U.S. Application Data

(63) Continuation of application No. PCT/JP2015/067597, filed on Jun. 18, 2015.

(30) Foreign Application Priority Data

Oct. 27, 2014 (JP) ..... 2014-218249

(51) Int. Cl.
*H01R 13/405* (2006.01)
*H01R 13/52* (2006.01)
*H01R 13/6587* (2011.01)

(52) U.S. Cl.
CPC ..... *H01R 13/5213* (2013.01); *H01R 13/5202* (2013.01); *H01R 13/6587* (2013.01)

(58) Field of Classification Search
CPC ..... H01R 13/6587; H01R 13/5202; H01R 13/5213
(Continued)

(56) References Cited

U.S. PATENT DOCUMENTS 4,830,630 A * 5/1989 Dozier ..... H01R 13/521 174/152 GM
5,433,628 A * 7/1995 Sadaishi ..... H01R 4/64 29/883
(Continued)

FOREIGN PATENT DOCUMENTS

JP H07-207151 A 8/1995
JP 11-335532 A 12/1999
(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

A waterproof connector includes a housing made of a material in which reinforcing filler pieces are dispersed in an insulating resin, and a conductive member formed integrally with the housing, the conductive member having a connector connecting section exposed from the housing and connected to a counter connector, a board connecting section exposed from the housing and connected to a board, and a fixed section connecting the connector connecting section and the board connecting section and embedded in the housing, a waterproof shaped section for blocking entry of water along an interface between the fixed section and the housing being formed at a surface of the fixed section, the waterproof shaped section including at least one groove having an opening width smaller than a size of each of the reinforcing filler pieces.

12 Claims, 6 Drawing Sheets

(58) Field of Classification Search
USPC ..... 439/78, 660, 736, 733.1
See application file for complete search history.

(56) References Cited

U.S. PATENT DOCUMENTS 6,083,051 A * 7/2000 Chang ..... H01R 12/716 439/660
6,958,674 B2 * 10/2005 Tsuchida ..... H01C 10/44 338/162
7,723,619 B2 * 5/2010 Ohashi ..... B29C 45/0025 174/260
8,011,976 B2 * 9/2011 Ooki ..... H01R 13/50 439/736
8,475,211 B2 * 7/2013 Wang ..... H01R 12/724 439/607.38
9,608,359 B2 * 3/2017 Arai ..... H01R 12/716
9,618,968 B2 * 4/2017 Simonsson ..... G06F 1/1613
2003/0214382 A1 * 11/2003 Tsuchida ..... H01C 10/44 338/162
2004/0192117 A1 * 9/2004 Mott ..... H01R 13/04 439/736
2011/0076897 A1 * 3/2011 Lemke ..... H01R 12/57 439/733.1
2013/0065442 A1 * 3/2013 Nagata ..... H01R 13/5202 439/607.58
2014/0113497 A1 * 4/2014 Wang ..... H01R 13/52 439/660
2014/0141647 A1 * 5/2014 Do ..... H01R 13/405 439/606
2015/0126055 A1 * 5/2015 Morita ..... H01R 13/5202 439/323
2015/0236441 A1 * 8/2015 Kim ..... H01R 13/521 439/587
2016/0036155 A1 * 2/2016 Kataoka ..... H01R 13/521 439/736
2016/0104957 A1 * 4/2016 Kim ..... H01R 13/6581 439/78

FOREIGN PATENT DOCUMENTS

JP 5433776 B1 3/2014
JP 2014-130691 A 7/2014
JP 2014-186819 A 10/2014

* cited by examiner

WATERPROOF CONNECTOR

BACKGROUND OF THE INVENTION

The present invention relates to a waterproof connector, particularly to a waterproof connector in which conductive members such as contacts and a shell are formed integrally with a housing.

In recent years, there is a strong demand for waterproof function in various electronic devices and accordingly, waterproof connectors having waterproof properties have been under development as connectors for establishing connections with external devices.

One example of such waterproof connectors is a connector in which conductive members such as contacts and a shell are formed inside a housing made of an insulating resin to be integral with the housing by, for example, insert molding. Owing to the integral molding, surfaces of the conductive members tightly adhere to the insulating resin at portions embedded in the housing because of a shrinking force of the insulating resin, and water is prevented from penetrating from the outside to the inside of the connector through boundary portions between the housing and the conductive members.

In general, however, a metal material making up the conductive members, such as contacts and a shell, and a resin material making up the housing are different in thermal expansion coefficient from each other, and therefore, when, for example, the connector is exposed to a high temperature environment during a soldering process such as reflow mounting in mounting the connector onto a circuit board of an electronic device, due to the different degree of expansion between the conductive members and the insulating resin, the insulating resin tightly adhering to surfaces of the conductive members may be separated therefrom. Once separated, the surfaces of the conductive members and the insulating resin are to have gaps therebetween, and water may disadvantageously enter the inside of the connector through the gaps even after the temperature falls to ambient temperature.

Aside from that, in a fitting process of a counter connector with the connector, the counter connector may be forcibly fitted in a direction oblique to the fitting axis, which is so-called "ill fitting," and a high stress may be applied between the housing and the conductive members. In this case, again, the insulating resin of the housing may be separated from the surfaces of the conductive members, thereby damaging waterproof properties of the connector.

To cope with it, a waterproof connector in which a waterproof shaped section composed of grooves or protrusions is formed at the portion of a surface of a conductive member to be embedded in a housing to thereby improve waterproof properties, was filed by the present applicant and has been registered (JP 5433776 B).

In the waterproof connector of JP 5433776 B, for instance, as shown in FIG. 15A, a plurality of grooves 3 are formed in a surface of a fixed section of a conductive member 2 embedded and fixed in a housing 1 made of an insulating resin, so as to surround and enclose the periphery of the conductive member 2.

Owing to the grooves 3, even if the insulating resin constituting the housing 1 is separated from the surface of the conductive member 2 due to the difference between the thermal expansion coefficients of an insulating resin material and a metal material or due to so-called ill fitting, and water penetrates along the interface between the housing 1 and the conductive member 2, the penetrating water is blocked by the grooves 3.

Meanwhile, in recent years, as downsizing and densification of electric devices progress, a small connector is required, and use of a thin housing is desired accordingly. To minimize the decrease in strength of a connector caused by a thinner housing, for instance, JP 7-207151 A proposes a resin composition for connectors with higher shock resistance and heat resistance as obtained by mixing a resin material with an inorganic reinforcing material.

When, however, the housing 1 in the waterproof connector of JP 5433776 B is formed from the resin composition for connectors described in JP 7-207151 A in order to enhance both waterproof properties and strength, if an inorganic reinforcing material 4 contained in the resin composition for connectors enters the insides of the grooves 3 of the conductive member 2 as shown in FIG. 15B, the contact area between the resin material and the inner surfaces of the grooves 3 is reduced, resulting in the decrease in adhesion between the housing 1 and the grooves 3 of the conductive member 2. Thus, the decrease in adhesion of the housing 1 to the grooves 3 of the conductive member 2 may lead to lower waterproof properties of the connector.

SUMMARY OF THE INVENTION

The present invention has been made to eliminate the conventional drawback as above and is aimed at providing a waterproof connector that can improve the strength without damaging waterproof properties.

A waterproof connector according to the present invention includes:

a housing made of a material in which reinforcing filler pieces are dispersed in an insulating resin; and a conductive member formed integrally with the housing, wherein the conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, and wherein the waterproof shaped section includes at least one groove having an opening width smaller than a size of each of the reinforcing filler pieces.

DETAILED DESCRIPTION OF THE INVENTION

Figure 1A:
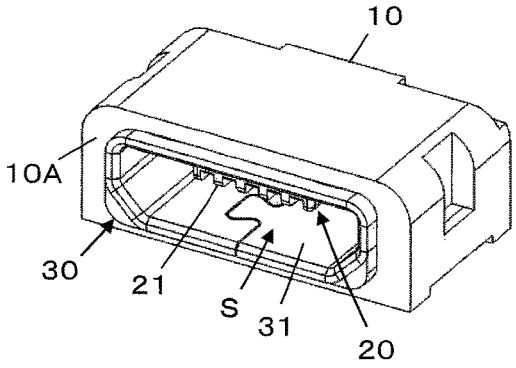
FIGS. 1A to 1D show a waterproof connector according to Embodiment 1 of the invention, FIG. 1A being a perspective view seen from an obliquely upper front position, FIG. 1B being a perspective view seen from an obliquely upper rear position, FIG. 1C being a perspective view seen from an obliquely lower front position, FIG. 1D being a perspective view seen from an obliquely lower rear position.
Figure 1B:
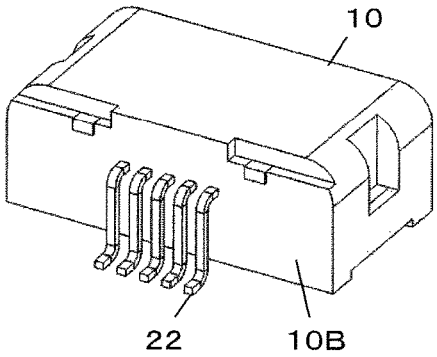
Figure 1C:
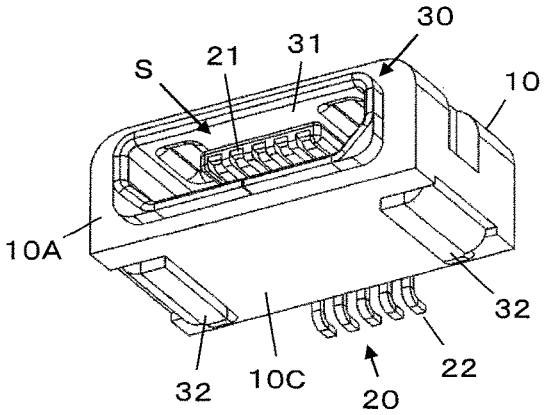
Figure 1D:
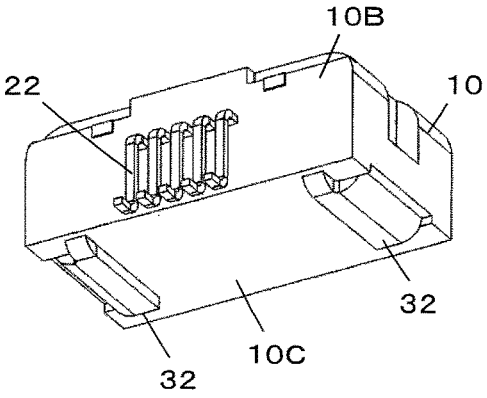
Figure 2A:
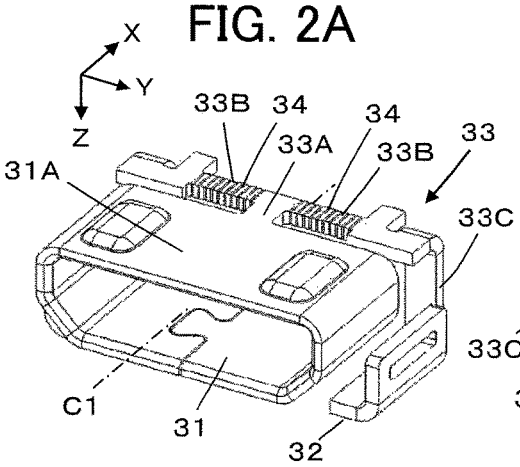
FIGS. 2A to 2D show a shell used in the waterproof connector according to Embodiment 1, FIG. 2A being a perspective view seen from an obliquely upper front position, FIG. 2B being a perspective view seen from an obliquely upper rear position, FIG. 2C being a perspective view seen from an obliquely lower front position, FIG. 2D being a perspective view seen from an obliquely lower rear position.
Figure 2B:
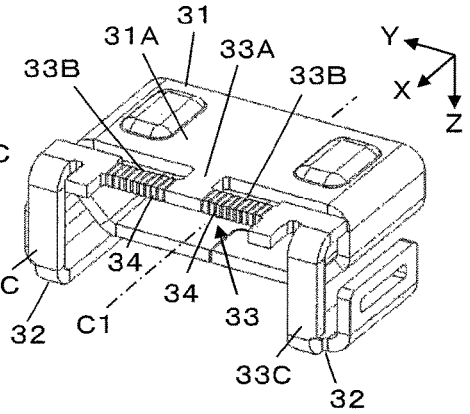
Figure 2C:
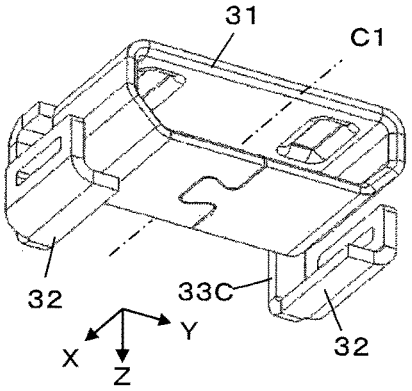
Figure 2D:
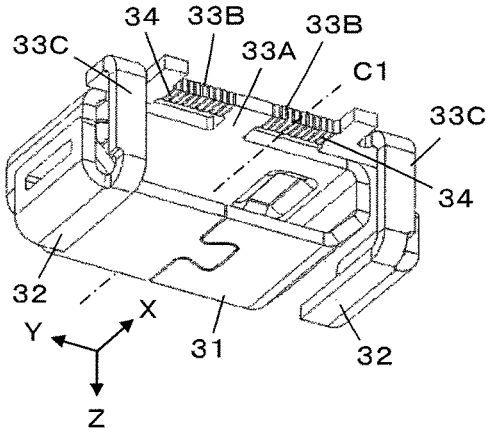

Embodiments of the present invention are described below based on the appended drawings.

Embodiment 1

FIGS. 1A to 1D show the structure of a waterproof connector according to Embodiment 1 of the present invention. The waterproof connector includes a housing 10 having a substantially cuboid outer shape, a plurality of contacts 20 fixed to the housing 10, and a shell 30 fixed to the housing 10 and configured to shield the contacts 20. The housing 10 is formed of a material in which reinforcing filler pieces are dispersed in an insulating resin, and the contacts 20 and the shell 30 are made of a metal material having conductivity.

The shell 30 includes a hollow fitted section (shell-side connector connecting section) 31 that opens at a front surface 10A side of the housing 10. A space S is formed in the fitted section 31 for fitting with a counter connector. A contact section (contact-side connector connecting section) 21 provided at the front end of each contact 20 lies in the space S of the fitted section 31 of the shell 30. On the other hand, a contact-side board connecting section 22 provided at the rear end of each contact 20 is exposed from a rear surface 10B of the housing 10 to the outside of the housing 10.

The shell 30 includes a pair of shell-side board connecting sections 32 that are exposed from a bottom surface 10C of the housing 10 to the outside of the housing 10.

As shown in FIGS. 2A to 2D, the fitted section 31 of the shell 30 has a central axis C1 and has a cylindrical shape whose sectional shape is flat and elongated in a direction perpendicular to the central axis C1. For ease of understanding, a direction extending from front to rear of the fitted section 31 in parallel to the central axis C1 is called "X direction," a plane along which a top surface 31A of the flat fitted section 31 extends "XY plane," and a direction perpendicular to the top surface 31A of the fitted section 31 and extending downward "Z direction."

The shell 30 includes a shell-side fixed section 33 connecting the fitted section 31 and the pair of shell-side board connecting sections 32. The shell-side fixed section 33 includes a rearward projecting section 33A that projects in the X direction from the middle of the upper rear end of the fitted section 31 along the central axis C1 of the fitted section 31, a pair of arm sections 33B that separately extend from the rear end of the rearward projecting section 33A in directions parallel to the top surface 31A of the flat fitted section 31 and perpendicular to the central axis C1, namely, in the Y and −Y directions, and a pair of leg sections 33C that separately extend downward, namely, in the Z direction from the tip ends of the arm sections 33B. The lower ends of the pair of leg sections 33C are separately connected to the shell-side board connecting sections 32. The pair of shell-side board connecting sections 32 are formed to extend from rear to front of the fitted section 31, i.e., in an XY plane and in the −X direction.

The rearward projecting section 33A, the pair of arm sections 33B and the pair of leg sections 33C of the shell-side fixed section 33 form a shell narrow section that is narrower than the fitted section 31. The shell-side fixed section 33 having the shell narrow section is embedded in the housing 10 when the housing 10 is formed by molding together with the shell 30.

A shell-side waterproof shaped section 34 is formed around the outer peripheral surface of each of the pair of arm sections 33B to block the entry of water along the interface between the arm section 33B and the housing 10. The shell-side waterproof shaped section 34 is formed so as to surround and enclose the periphery of the arm section 33B. A surface of the shell-side fixed section 33 is divided by the shell-side waterproof shaped section 34 into a portion containing the fitted section 31 and a portion containing the shell-side board connecting sections 32.

Figure 3:
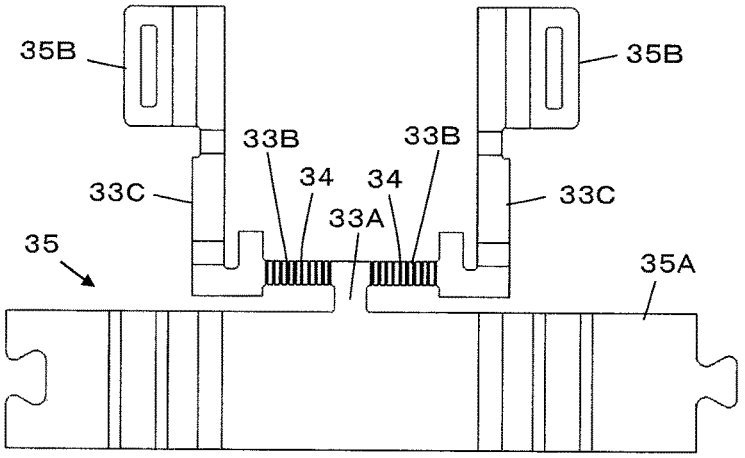
FIG. 3 is a development view showing the shell used in the waterproof connector according to Embodiment 1.

The shell 30 configured as above can be produced by cutting out a metal sheet 35 having conductivity into the shape shown in FIG. 3 and then bending the cut metal sheet by a press or the like. A band portion 35A is shaped into a flat cylindrical shape to form the fitted section 31, the rearward projecting section 33A projects from the middle of the outer edge of the band portion 35A, the pair of arm sections 33B are connected to the tip end of the rearward projecting section 33A, the pair of leg sections 33C are separately connected to the tip ends of the pair of arm sections 33B, and flat plate portions 35B separately connected to the tip ends of the pair of leg sections 33C form the shell-side board connecting sections 32.

As is evident from the development view of FIG. 3, the arm sections 33B having the shell-side waterproof shaped sections 34 are separately provided on the paths from the band portion 35A forming the fitted section 31 to the pair of flat plate portions 35B forming the shell-side board connecting sections 32.

Figure 4:
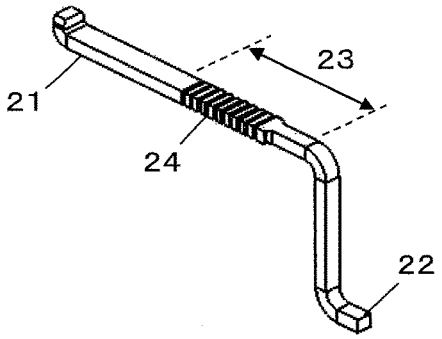
FIG. 4 is a perspective view showing a contact used in the waterproof connector according to Embodiment 1.

FIG. 4 shows the structure of the contact 20. The contact 20 is formed of a bar-shaped member or a flat plate member. A contact-side fixed section 23 is formed between the contact section 21 and the contact-side board connecting section 22. The contact-side fixed section 23 is a portion to be embedded in the housing 10 to fix the contact 20 to the housing 10 when the housing 10 is formed by molding together with the shell 30. A contact-side waterproof shaped section 24 is formed around the outer peripheral surface of the contact-side fixed section 23 to block the entry of water along the interface between the contact-side fixed section 23 and the housing 10. The contact-side waterproof shaped section 24 is formed so as to surround and enclose the periphery of the contact-side fixed section 23. The surface of the contact 20 is divided by the contact-side waterproof shaped section 24 into a portion containing the contact section 21 and a portion containing the contact-side board connecting section 22.

Figure 5:
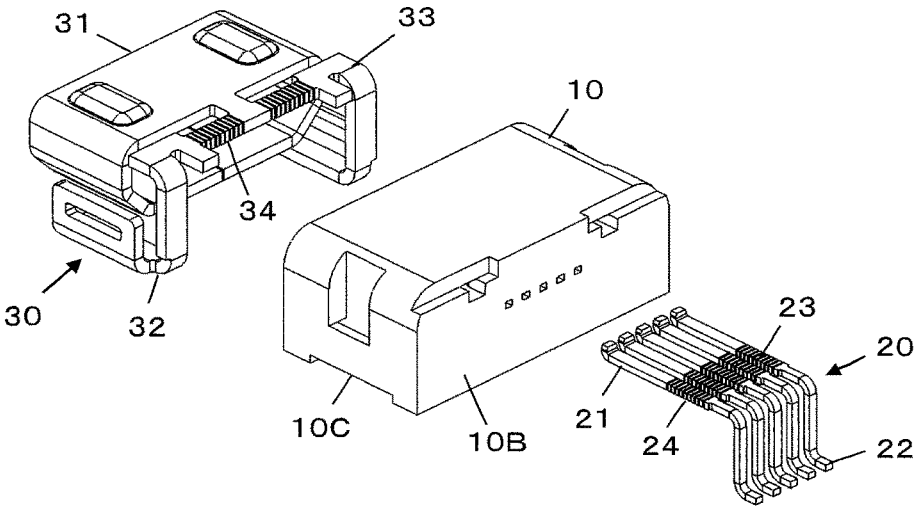
FIG. 5 is an exploded perspective view of the waterproof connector according to Embodiment 1.

FIG. 5 shows an exploded view of the waterproof connector. The housing 10 is formed integrally with the shell 30 and the contacts 20 by molding so that the inner surface of the fitted section 31 of the shell 30 is exposed at the front end of the housing 10, the shell-side fixed section 33 at which the shell-side waterproof shaped sections 34 are formed is embedded in the housing 10, the shell-side board connecting sections 32 are exposed from the bottom surface 10C of the housing 10, the contact sections 21 of the contacts 20 are exposed inside the fitted section 31 of the shell 30, the contact-side fixed sections 23 at which the contact-side waterproof shaped sections 24 are formed are embedded in the housing 10, and the contact-side board connecting sections 22 are exposed from the rear surface 10B of the housing 10.

In this case, the contacts 20 and the shell 30 are set in a mold (not shown) so that the contact sections 21 of the contacts 20 are positioned inside the fitted section 31 of the shell 30, the mold is closed, and a molten insulating resin material containing the dispersed reinforcing filler pieces is injected into the mold and cooled, whereby the housing 10 is formed integrally with the contacts 20 and the shell 30. The waterproof connector shown in FIGS. 1A to 1D can be thus manufactured.

Figure 6:
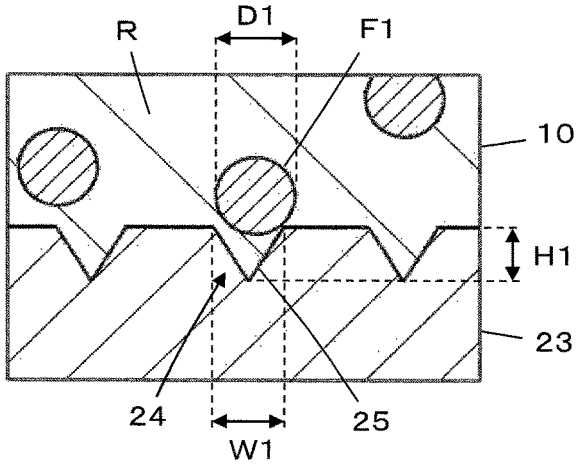
FIG. 6 is a partial cross-sectional view showing a boundary section between a housing and a fixed section of the contact in the waterproof connector according to Embodiment 1.

In FIG. 6, a boundary section between the housing 10 and the contact-side fixed section 23 is shown. The housing 10 is formed of a material in which a large number of reinforcing filler pieces F1 are dispersed in an insulating resin R. One example of the reinforcing filler pieces F1 is beads formed of an inorganic substance such as glass and having a spherical outer shape with a diameter D1.

The contact-side waterproof shaped section 24 of the contact-side fixed section 23 has a plurality of grooves 25 of V shape in cross section formed in the surface of the contact-side fixed section 23. The grooves 25 each have a height difference H1 and an opening width W1. The height difference H1 of the groove 25 is preferably not less than 0.01 mm in order to block the entry of water along the interface between the contact-side fixed section 23 and the housing 10. The opening width W1 of the groove 25 is set smaller than the diameter D1 of the reinforcing filler piece F1 in advance.

Since the opening width W1 of the groove 25 is thus smaller than the diameter D1 of the reinforcing filler piece F1, the reinforcing filler pieces F1 contained in a molding material of the housing 10 do not enter the insides of the grooves 25 formed in the surface of the contact-side fixed section 23 during integral molding of the housing 10 with the contacts 20 in a mold. Therefore, the contact area between the insulating resin R and the inner surfaces of the grooves 25 is prevented from being reduced due to entry of the reinforcing filler pieces F1 to the insides of the grooves 25, while the flow of the molding material entering is not disturbed in molding so that the grooves 25 are filled up to their tip ends with the molding material, which allows the housing 10 to tightly and firmly adhere to the grooves 25 of the contact-side fixed section 23. Thus, it is possible to cause the housing 10 to tightly and firmly adhere to the grooves 25 of the contact-side fixed section 23 to ensure waterproof properties, while improving strength of the housing 10 using the insulating resin R containing the dispersed reinforcing filler pieces F1.

Similarly to the contact-side waterproof shaped section 24, the shell-side waterproof shaped sections 34 formed around the outer peripheral surfaces of the arm sections 33B of the shell-side fixed section 33 each have a plurality of grooves of V shape in cross section formed in the surface of the shell-side fixed section 33, with the grooves each having the height difference H1 and the opening width W1 smaller than the diameter D1 of the reinforcing filler piece F1.

Thus, also in the case of the shell 30, as with the contacts 20, the reinforcing filler pieces F1 contained in the molding material of the housing 10 do not enter the insides of the grooves formed in the surface of the shell-side fixed section 33 during integral molding of the housing 10 with the shell 30 in a mold, and therefore, the contact area between the insulating resin R and the inner surfaces of the grooves is prevented from being reduced, while the flow of the molding material entering is not disturbed in molding so that the grooves are filled up to their tip ends with the molding material, which allows the housing 10 to tightly and firmly adhere to the grooves of the shell-side fixed section 33. Thus, it is possible to cause the housing 10 to tightly and firmly adhere to the grooves of the shell-side fixed section 33 to ensure waterproof properties, while improving strength of the housing 10 using the insulating resin R containing the dispersed reinforcing filler pieces F1.

Figure 7:
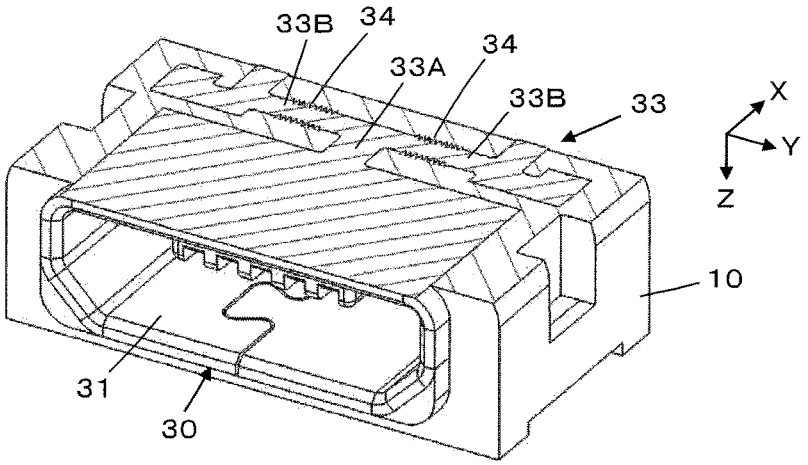
FIG. 7 is a perspective view showing the waterproof connector according to Embodiment 1 cut at the height at which a shell waterproof shaped section lies.

FIG. 7 shows the waterproof connector according to Embodiment 1 cut along an XY plane at the height at which the pair of arm sections 33B of the shell 30 lie. The shell-side fixed section 33 of the shell 30 is embedded in the housing 10, and the pair of arm sections 33B are connected to the fitted section 31 via the rearward projecting section 33A. The inner surface of the fitted section 31 is not covered by the housing 10 but is exposed. The shell-side waterproof shaped sections 34 are formed at the arm sections 33B so as to surround and enclose the peripheries of the arm sections 33B. The sectional shapes of the shell-side waterproof shaped sections 34 appear at both lateral edges of the cross sections of the arm sections 33B.

Figure 8:
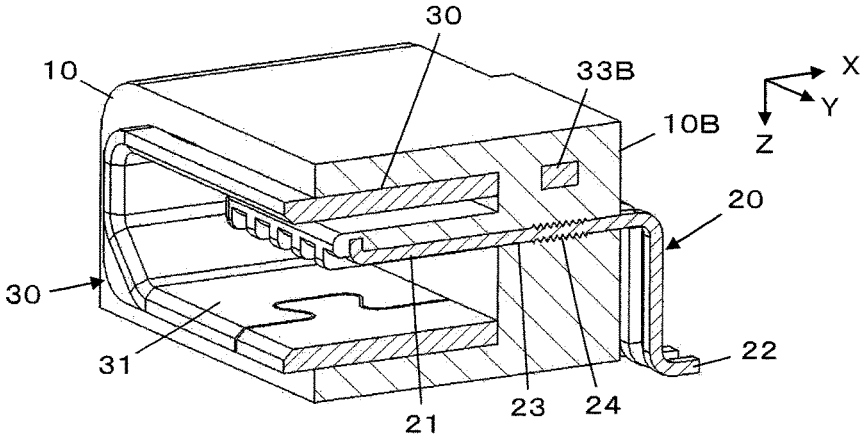
FIG. 8 is a perspective view showing the waterproof connector according to Embodiment 1 cut at the position where one contact lies.

FIG. 8 shows the waterproof connector cut along an XZ plane at the position where one contact 20 lies. The contact section 21 of each contact 20 is exposed inside the fitted section 31 of the shell 30, the contact-side board connecting section 22 projects and is exposed rearward from the rear surface 10B of the housing 10, and the contact-side fixed section 23 is embedded in the housing 10. A cross section of the arm section 33B of the shell 30 is seen above the contact-side fixed section 23 of the contact 20. The contact-side waterproof shaped section 24 is formed at the contact-side fixed section 23 of the contact 20 so as to surround and enclose the periphery of the contact-side fixed section 23, and the sectional shape of the contact-side waterproof shaped section 24 appears at both lateral edges of the cross section of the contact-side fixed section 23.

As described above, the contact-side waterproof shaped sections 24 are formed at the contact-side fixed sections 23 of the contacts 20 to be embedded in the housing 10 so as to surround and enclose the peripheries of the contact-side fixed sections 23. With this configuration, even if the insulating resin R of the housing 10 tightly adhering to the surfaces of the contact-side fixed sections 23 of the contacts 20 is separated from any of the contact-side fixed sections 23 and water penetrates along the contact section 21 exposed to the inside of the fitted section 31 of the shell 30 and then along the interface between the contact-side fixed section 23 and the housing 10, the penetrating water is blocked by the contact-side waterproof shaped section 24 and prevented from reaching the contact-side board connecting section 22 exposed from the rear surface 10B of the housing 10.

Likewise, the shell-side waterproof shaped sections 34 are formed at the shell-side fixed section 33 of the shell 30 to be embedded in the housing 10 so as to surround and enclose the peripheries of the arm sections 33B provided on the paths from the fitted section 31 to the shell-side board connecting sections 32. Therefore, even if the insulating resin R of the housing 10 tightly adhering to the surfaces of the shell-side fixed section 33 of the shell 30 is separated from the shell-side fixed section 33 due to, for instance, the difference between the thermal expansion coefficients of the insulating resin R of the housing 10 and the metal material constituting the shell 30 or due to so-called ill fitting in which the waterproof connector is forcibly fitted in a direction oblique to the fitting axis during fitting with a counter connector, and water penetrates from the fitted section 31 and along the interface between the shell-side fixed section 33 and the housing 10, the penetrating water is blocked by the shell-side waterproof shaped section 34 as soon as reaching the arm section 33B of the shell-side fixed section 33 and is prevented from reaching the shell-side board connecting section 32 exposed from the bottom surface 10C of the housing 10.

In particular, the arm sections 33B at which the shell-side waterproof shaped sections 34 are formed are constituent portions of the shell narrow section that is narrower than the fitted section 31, and accordingly, the entry path of water is so narrow as to limit the amount of penetrating water. Therefore, owing to the shell-side waterproof shaped sections 34, the waterproof function can work more effectively.

The waterproof properties between the housing 10 and the shell 30 and contacts 20 are thus improved so that water can be prevented from penetrating to the interior of a device, i.e., to the side at which a board having mounted thereon the waterproof connector is placed.

Although the contact-side waterproof shaped section 24 shown in FIG. 6 has the plurality of grooves 25 of V shape in cross section, the invention is not limited thereto. A contact-side waterproof shaped section only with a single groove 25 can still minimize the entry of water along the interface with the housing 10. The provision of the plurality of grooves 25, however, leads to more excellent waterproof function.

Similarly, while the shell-side waterproof shaped section 34 can be composed of a single groove, the provision of the plurality of grooves leads to more excellent waterproof effect.

The shape of the grooves 25 of the contact-side waterproof shaped section 24 and the grooves of the shell-side waterproof shaped section 34 is not limited to the V-shaped cross section as long as those grooves each have the height difference H1 for blocking the entry of water and the opening width W1 smaller than the diameter D1 of the reinforcing filler piece F1 of the housing 10. For instance, grooves of U shape or rectangular shape in cross section may be employed.

While the beads having a spherical outer shape with the diameter D1 are used as the reinforcing filler pieces F1, the invention is not limited thereto, and use may be made of reinforcing filler pieces F1 having fibrous or bar-like outer shape such as glass fibers or carbon fibers. In this case, the grooves 25 of the contact-side waterproof shaped section 24 and the grooves of the shell-side waterproof shaped section 34 each preferably have the opening width W1 smaller than the cross-sectional diameter of the fibrous reinforcing filler piece F1.

Alternatively, use may be made of reinforcing filler pieces F1 having sheet- or laminate-like outer shape such as micas. In this case, the grooves 25 of the contact-side waterproof shaped section 24 and the grooves of the shell-side waterproof shaped section 34 each preferably have the opening width W1 smaller than the sheet length and sheet width of the reinforcing filler piece F1 measured along its surface.

In place of the pair of shell-side board connecting sections 32 exposed from the bottom surface 10C of the housing 10, the shell 30 may have a single shell-side board connecting section 32 or three or more shell-side board connecting sections 32. When a single shell-side board connecting section 32 is provided, the configuration may be applied in which a single arm section 33B is formed on the path from the fitted section 31 to the shell-side board connecting section 32 and the shell-side waterproof shaped section 34 is formed at the surface of the arm section 33B. When the shell 30 has three or more shell-side board connecting sections 32, the shell-side waterproof shaped section(s) 34 may be provided on any of the paths from the fitted section 31 to the respective shell-side board connecting sections 32, and the number of arm sections 33B at which the shell-side waterproof shaped section(s) 34 is formed may be equal to or smaller than the number of the shell-side board connecting sections 32.

While the fitted section 31 of the shell 30 has a flat cylindrical shape so as to cover the entire surrounding of the contact sections 21 of the contacts 20, the invention is not limited thereto. The fitted section 31 covering merely a part of the contact sections 21 of the contacts 20 can still bring about a shielding effect depending on the usage of the waterproof connector. When such a shielding effect is not required and a shell is used for the purpose of attaching the waterproof connector to a board via the shell-side board connecting sections 32, the shell need not cover the contact sections 21 of the contacts 20.

Embodiment 2

In Embodiment 1 above, the contact-side waterproof shaped section 24 has the plurality of grooves 25 of V shape in cross section formed in the surface of the contact-side fixed section 23, and each of the grooves 25 has the height difference H1 for blocking the entry of water along the interface between the housing 10 and the contact-side fixed section 23 and the opening width W1 smaller than the diameter D1 of the reinforcing filler piece F1; however, the invention is not limited thereto.

Figure 9:
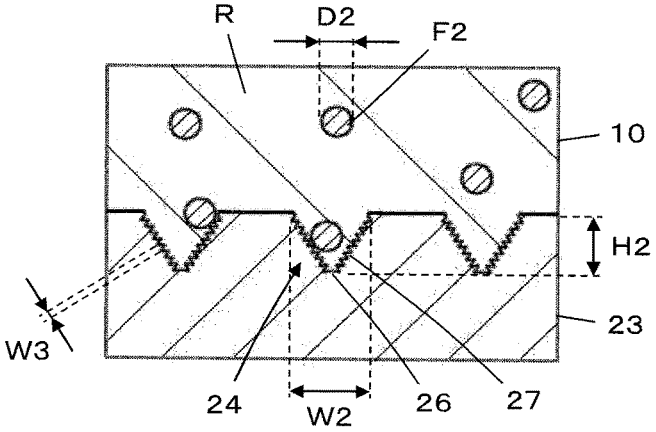
FIG. 9 is a partial cross-sectional view showing a boundary section between a housing and a fixed section of a contact in a waterproof connector according to Embodiment 2.

In a waterproof connector of Embodiment 2 shown in FIG. 9, a plurality of recesses 26 of V shape in cross section are formed in the surface of the contact-side fixed section 23, and a plurality of grooves 27 of V shape in cross section are further formed in the inner wall surface of each recess 26.

The housing 10 is formed of a material in which a large number of reinforcing filler pieces F2 are dispersed in the insulating resin R, the reinforcing filler pieces F2 being made of glass and having a spherical outer shape with a diameter D2.

The recesses 26 each have a height difference H2 and an opening width W2 larger than the diameter D2 of the reinforcing filler piece F2 of the housing 10. The height difference H2 of the recess 26 is preferably not less than 0.01 mm in order to block the entry of water along the interface between the housing 10 and the contact-side fixed section 23. The grooves 27 formed in the inner wall surfaces of the recesses 26 each have an opening width W3 smaller than the diameter D2 of the reinforcing filler piece F2 of the housing 10.

In Embodiment 2, since the recesses 26 formed in the surface of the contact-side fixed section 23 each have the opening width W2 larger than the diameter D2 of the reinforcing filler piece F2, the reinforcing filler pieces F2 contained in a molding material of the housing 10 may enter the insides of the recesses 26 formed in the surface of the contact-side fixed section 23 during integral molding of the housing 10 with the contacts 20 in a mold. However, the grooves 27 formed in the inner wall surfaces of the recesses 26 each have the opening width W3 smaller than the diameter D2 of the reinforcing filler piece F2 and accordingly, the reinforcing filler pieces F2 do not enter the insides of the grooves 27. Therefore, the contact area between the insulating resin R and the inner surfaces of the grooves 27 is prevented from being reduced, while the flow of the molding material entering is not disturbed in molding so that the grooves 27 are filled up to their tip ends with the molding material, which allows the housing 10 to tightly and firmly adhere to the grooves 27 inside the recesses 26.

Thus, it is possible to cause the housing 10 to tightly and firmly adhere to the grooves 27 of the contact-side fixed section 23 to ensure waterproof properties, while improving strength of the housing 10 using the insulating resin R containing the dispersed reinforcing filler pieces F2, and to further improve waterproof properties by providing, in addition to the recesses 26 with the large opening width W2, the grooves 27 with the small opening width W3 in the inner wall surfaces of the recesses 26.

Likewise, the shell-side waterproof shaped sections 34 formed around the outer peripheral surfaces of the arm sections 33B of the shell-side fixed section 33 may be configured to include recesses having the opening width W2 larger than the diameter D2 of the reinforcing filler piece F2 and grooves formed in the inner wall surfaces of the recesses and having the opening width W3 smaller than the diameter D2 of the reinforcing filler piece F2.

Thus, the reinforcing filler pieces F2 contained in the molding material of the housing 10 do not enter the insides of the grooves formed in the inner wall surfaces of the recesses during integral molding of the housing 10 with the shell 30 in a mold, and therefore, the contact area between the insulating resin R and the inner surfaces of the grooves is prevented from being reduced, while the flow of the molding material entering is not disturbed in molding so that the grooves are filled up to their tip ends with the molding material, which allows the housing 10 to tightly and firmly adhere to the grooves of the shell-side fixed section 33. Thus, it is possible to cause the housing 10 to tightly and firmly adhere to the grooves of the shell-side fixed section 33 to ensure waterproof properties, while improving strength of the housing 10 using the insulating resin R containing the dispersed reinforcing filler pieces F2.

While a substance having a spherical outer shape with the diameter D2 is used for the reinforcing filler pieces F2, the invention is not limited thereto, and use may be made of reinforcing filler pieces F2 having fibrous or bar-like outer shape such as glass fibers or carbon fibers. In this case, the grooves 27 of the contact-side waterproof shaped section 24 and the grooves formed in the inner wall surfaces of the recesses of the shell-side waterproof shaped section 34 each preferably have the opening width W3 smaller than the cross-sectional diameter of the fibrous reinforcing filler piece F2.

Alternatively, use may be made of reinforcing filler pieces F2 having sheet- or laminate-like outer shape such as micas. In this case, the grooves 27 of the contact-side waterproof shaped section 24 and the grooves formed in the inner wall surfaces of the recesses of the shell-side waterproof shaped section 34 each preferably have the opening width W3 smaller than the sheet length and sheet width of the reinforcing filler piece F2 measured along its surface.

Embodiment 3

While the shell-side waterproof shaped section 34 is formed at the arm section 33B of the shell-side fixed section 33 in the shell 30 in Embodiment 1 above, the place to be formed is not limited to the arm section 33B but may be anywhere as long as it is a narrow section of the shell-side fixed section 33 that is to be embedded in the housing 10 and is provided on the path from the fitted section 31 to the shell-side board connecting section 32.

Figure 10:
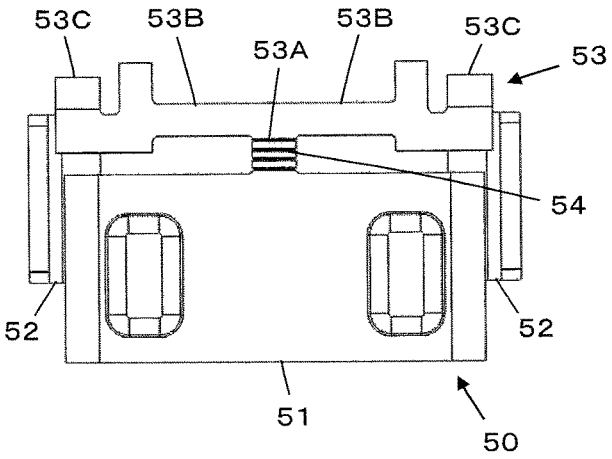
FIG. 10 is a plan view showing a shell used in a waterproof connector according to Embodiment 3.

For instance, as in a shell 50 shown in FIG. 10, a shell-side waterproof shaped section 54 may be formed at a surface of a rearward projecting section 53A that projects rearward from the rear end of a fitted section 51. The shell-side waterproof shaped section 54 is configured similarly to the contact-side waterproof shaped section 24 shown in FIG. 6 and the shell-side waterproof shaped section 34 in Embodiment 1. The shell 50 has the same configuration as that of the shell 30 used in Embodiment 1 except that the shell-side waterproof shaped section 54 is formed at the rearward projecting section 53A. Specifically, a shell-side fixed section 53 is positioned between the fitted section 51 and a pair of shell-side board connecting sections 52; the shell-side fixed section 53 includes the rearward projecting section 53A, a pair of arm sections 53B connected to the rear end of the rearward projecting section 53A, and a pair of leg sections 53C connected to the tip ends of the arm sections 53B; and the tip ends of the leg sections 53C are connected to the corresponding shell-side board connecting sections 52.

To reach from the fitted section 51 to the shell-side board connecting sections 52 along surfaces of the shell 50, it is necessary to pass the rearward projecting section 53A. Therefore, by forming the shell-side waterproof shaped section 54 around the outer peripheral surface of the rearward projecting section 53A, the entry of water along the interface between the shell-side fixed section 53 and the housing 10 can be blocked.

Instead of the rearward projecting section 53A, the shell-side waterproof shaped sections 54 may be formed at surfaces of the pair of leg sections 53C in the same manner.

Even with the configuration above, by forming the housing 10 from the material in which a large number of the reinforcing filler pieces F1 are dispersed in the insulating resin R and forming the shell-side waterproof shaped section 54 with the grooves having the opening width W1 smaller than the diameter D1 of the reinforcing filler piece F1 as in Embodiment 1, it is possible to cause the housing 10 to tightly and firmly adhere to the grooves of the shell-side waterproof shaped section 54 to ensure waterproof properties.

Likewise, by forming the housing 10 from the material in which a large number of the reinforcing filler pieces F2 are dispersed in the insulating resin R and forming the shell-side waterproof shaped section 54 including the recesses with the opening width W2 larger than the diameter D2 of the reinforcing filler piece F2 and the grooves with the opening width W3 smaller than the diameter D2 of the reinforcing filler piece F2 as in Embodiment 2, the housing 10 can be caused to tightly and firmly adhere to the grooves of the shell-side waterproof shaped section 54 to ensure waterproof properties.

Embodiment 4

In the shells 30 and 50 used in Embodiments 1 and 3 above, the shell-side waterproof shaped sections 34 and 54 are respectively formed at the leg sections 33C and the rearward projecting section 53A, which are the narrow sections, but are not necessarily formed at such a narrow section.

Figure 11:
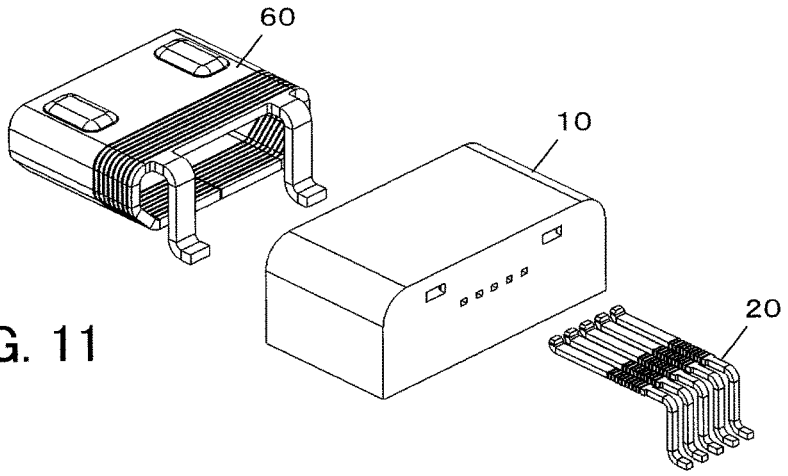
FIG. 11 is an exploded perspective view of a waterproof connector according to Embodiment 4.

FIG. 11 shows an exploded perspective view of a waterproof connector according to Embodiment 4. In this waterproof connector, a shell 60 with no narrow section is used in the waterproof connector of Embodiment 1 in place of the shell 30.

Figure 12:
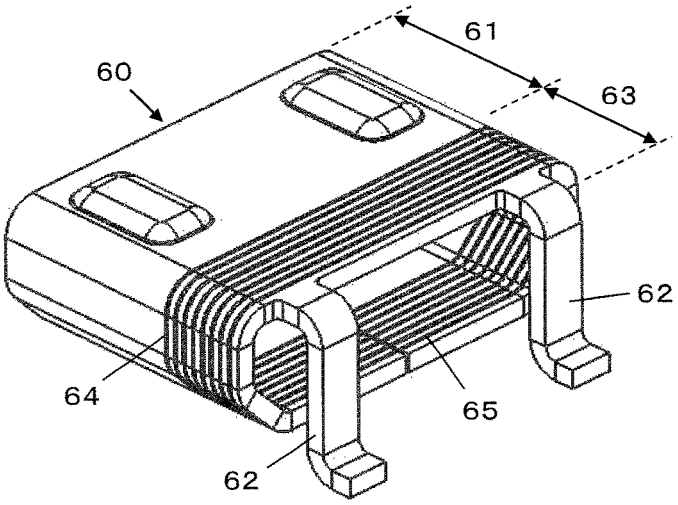
FIG. 12 is a perspective view showing a shell used in the waterproof connector according to Embodiment 4.

As shown in FIG. 12, the shell 60 has a hollow fitted section 61 in a flat cylindrical shape and a hollow shell-side fixed section 63 in a flat cylindrical shape connected to the rear end of the fitted section 61. A pair of shell-side board connecting sections 62 are formed to project from the rear end of the shell-side fixed section 63. In other words, one cylindrical body is divided into a front end portion and a rear end portion with the front end portion being defined as the fitted section 61 and the rear end portion being defined as the shell-side fixed section 63.

The fitted section 61 covers the surrounding of the contact sections 21 provided at the front ends of the contacts 20 with its inner surface portion being exposed from the housing 10. The inner and outer surface portions of the shell-side fixed section 63 are fully embedded in the housing 10.

A shell-side waterproof shaped section 64 is formed at the outer peripheral surface of the shell-side fixed section 63, while a shell-side waterproof shaped section 65 is also formed at the inner peripheral surface of the shell-side fixed section 63. The shell-side waterproof shaped section 64 is formed so as to surround and enclose the outer periphery of the shell-side fixed section 63, while the shell-side waterproof shaped section 65 is formed so as to surround and enclose the inner periphery of the shell-side fixed section 63.

To reach from the fitted section 61 to the shell-side board connecting sections 62 along surfaces of the shell 60, it is necessary to go across the shell-side waterproof shaped section 64 or 65. Thus, owing to the shell-side waterproof shaped sections 64 and 65, the entry of water along the interface between the shell-side fixed section 63 and the housing 10 can be blocked.

Figure 13:
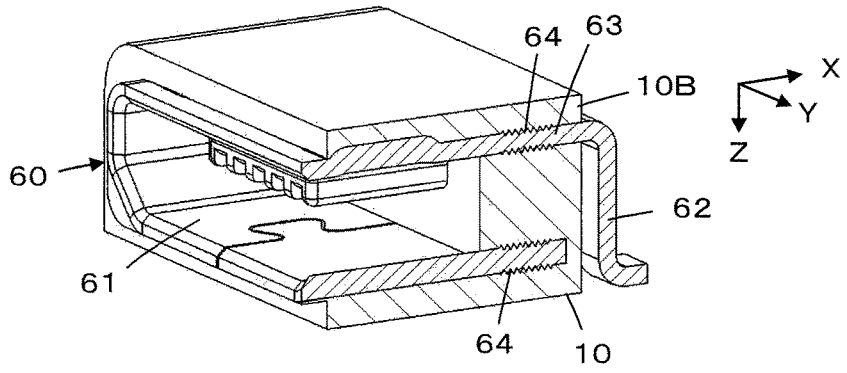
FIG. 13 is a perspective view showing the waterproof connector according to Embodiment 4 cut at the position where a board connecting section of the shell lies.

FIG. 13 shows the waterproof connector according to Embodiment 3 cut along an XZ plane at the position where one shell-side board connecting section 62 lies. The inner surface of the fitted section 61 of the shell 60 is not covered by the housing 10 but is exposed, the shell-side fixed section 63 is embedded in the housing 10, and the shell-side board connecting sections 62 connected to the rear end of the shell-side fixed section 63 project and are exposed from the rear surface 10B of the housing 10. The shell-side waterproof shaped sections 64 and 65 are formed at the outer and inner peripheral surfaces of the shell-side fixed section 63, respectively, and therefore the sectional shapes of the shell-side waterproof shaped sections 64 and 65 appear at both lateral edges of the cross section of the shell-side fixed section 63.

Figure 14:
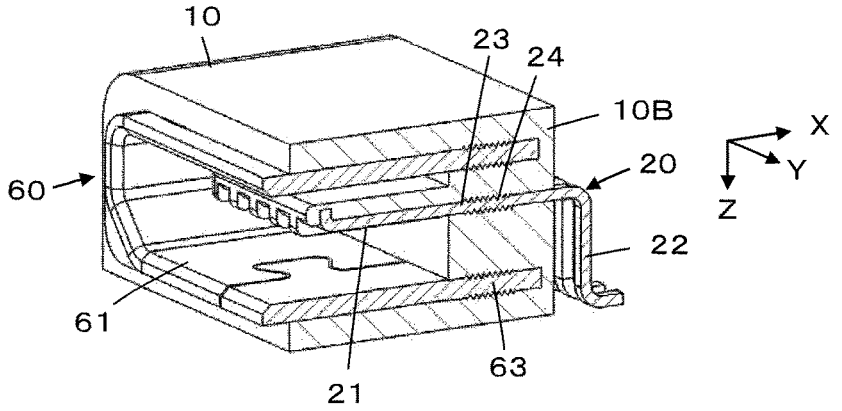
FIG. 14 is a perspective view showing the waterproof connector according to Embodiment 4 cut at the position where one contact lies.
Figure 15A:
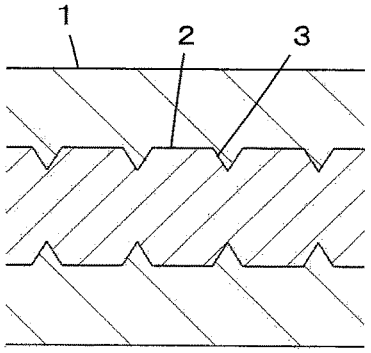
FIG. 15A PRIOR ART
FIG. 15A is a partial cross-sectional view showing a fixed section of a conductive member embedded in a housing of a conventional waterproof connector.
Figure 15B:
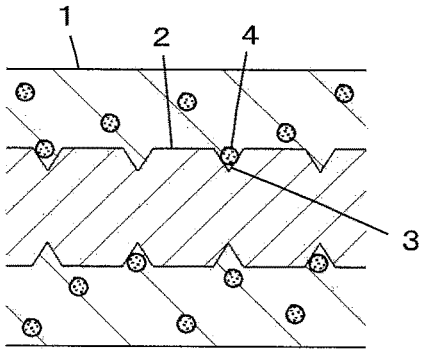
FIG. 15B PRIOR ART
FIG. 15B is a partial cross-sectional view showing the state where an inorganic reinforcing material of the housing enters the insides of grooves formed in the conductive member of the conventional waterproof connector.

FIG. 14 shows the waterproof connector cut along an XZ plane at the position where one contact 20 lies. The contact section 21 of each contact 20 is exposed inside the fitted section 61 of the shell 60, the contact-side board connecting section 22 projects and is exposed rearward from the rear surface 10B of the housing 10, and the contact-side fixed section 23 is embedded in the housing 10. The contact-side waterproof shaped sections 24 are formed at the contact-side fixed section 23 of the contact 20 so as to surround and enclose the periphery of the contact-side fixed section 23. Accordingly, the sectional shape of the contact-side waterproof shaped section 24 appears at both lateral edges of the cross section of the contact-side fixed section 23.

Even with the configuration above, by forming the housing 10 from the material in which a large number of the reinforcing filler pieces F1 are dispersed in the insulating resin R and forming the shell-side waterproof shaped sections 64 and 65 with the grooves having the opening width W1 smaller than the diameter D1 of the reinforcing filler piece F1 as in Embodiment 1, it is possible to cause the housing 10 to tightly and firmly adhere to the grooves of the shell-side waterproof shaped sections 64 and 65 to ensure waterproof properties.

Likewise, by forming the housing 10 from the material in which a large number of the reinforcing filler pieces F2 are dispersed in the insulating resin R and forming the shell-side waterproof shaped sections 64 and 65 including the recesses with the opening width W2 larger than the diameter D2 of the reinforcing filler piece F2 and the grooves with the opening width W3 smaller than the diameter D2 of the reinforcing filler piece F2 as in Embodiment 2, the housing 10 can be caused to tightly and firmly adhere to the grooves of the shell-side waterproof shaped sections 64 and 65 to ensure waterproof properties.

What is claimed is:

1. A waterproof connector comprising:

a housing made of a material in which reinforcing filler pieces are dispersed in an insulating resin; and a conductive member formed integrally with the housing, wherein the conductive member has a connector connecting section exposed from the housing and connected to a counter connector, a board connecting section exposed from the housing and connected to a board, and a fixed section connecting the connector connecting section and the board connecting section and embedded in the housing, wherein a waterproof shaped section for blocking entry of water along an interface between the fixed section and the housing is formed at a surface of the fixed section, and wherein the waterproof shaped section includes at least one groove having an opening width smaller than a size of each of the reinforcing filler pieces.

2. The waterproof connector according to claim 1, wherein the at least one groove is formed in the surface of the fixed section.

3. The waterproof connector according to claim 1, wherein the waterproof shaped section has at least one recess formed in the surface of the fixed section, and the at least one groove is formed in an inner wall surface of the at least one recess.

4. The waterproof connector according to claim 1, wherein the reinforcing filler pieces have a spherical outer shape, and wherein the at least one groove has an opening width smaller than a diameter of each of the reinforcing filler pieces.

5. The waterproof connector according to claim 1, wherein the reinforcing filler pieces have a fibrous outer shape, and wherein the at least one groove has an opening width smaller than a cross-sectional diameter of each of the reinforcing filler pieces.

6. The waterproof connector according to claim 1, wherein the reinforcing filler pieces have a sheet-like outer shape, and wherein the at least one groove has an opening width smaller than a sheet length or sheet width of each of the reinforcing filler pieces measured along a surface thereof.

7. The waterproof connector according to claim 1, wherein the reinforcing filler pieces are composed of an inorganic substance.

8. The waterproof connector according to claim 1, wherein the waterproof shaped section is formed so as to surround and enclose a periphery of the fixed section.

9. The waterproof connector according to claim 1, wherein the conductive member comprises one or more contacts, and wherein the connector connecting section is a contact section that comes into contact with a contact of the counter connector.

10. The waterproof connector according to claim 1, wherein the conductive member comprises a shell, wherein the connector connecting section is a fitted section to be fitted with the counter connector, wherein the fixed section includes a shell narrow section formed to be narrower than the connector connecting section, and wherein the waterproof shaped section is formed at a surface of the shell narrow section.

11. The waterproof connector according to claim 1, wherein the conductive member comprises a shell, wherein the connector connecting section is a fitted section to be fitted with the counter connector, wherein the fixed section has a hollow shape, and wherein the waterproof shaped section is formed at each of an outer peripheral surface and an inner peripheral surface of the fixed section.

12. The waterproof connector according to claim 1, wherein the conductive member comprises a shell and one or more contacts, and wherein the waterproof shaped section is formed at each of the shell and the one or more contacts.

* * * * *